US007828457B2

(12) United States Patent
Davidoff et al.

(10) Patent No.: US 7,828,457 B2
(45) Date of Patent: Nov. 9, 2010

(54) CARRY BAG MODULAR ORGANIZER SYSTEM

(76) Inventors: Debbie Lee Davidoff, 4531 Rebel Valley View, Atlanta, GA (US) 30339-5349; Colleen Margaret Haratsis, 3515 Vernadean Dr., Atlanta, GA (US) 30339

( * ) Notice: Subject to any disclaimer, the term of this patent is extended or adjusted under 35 U.S.C. 154(b) by 1072 days.

(21) Appl. No.: 11/502,141

(22) Filed: Aug. 9, 2006

(65) Prior Publication Data

US 2007/0044877 A1 Mar. 1, 2007

Related U.S. Application Data

(60) Provisional application No. 60/712,285, filed on Aug. 29, 2005.

(51) Int. Cl.
*F21L 4/00* (2006.01)

(52) U.S. Cl. ..... 362/156; 362/109; 362/554; 362/556

(58) Field of Classification Search ..... 362/156, 362/554, 556, 108, 109, 154; 150/138, 139, 150/140, 113, 117
See application file for complete search history.

(56) References Cited

U.S. PATENT DOCUMENTS

| | | | | | |
|---|---|---|---|---|---|
| 4,311,178 | A * | 1/1982 | Kennedy | ..... | 206/315.6 |
| 4,640,392 | A * | 2/1987 | Decke et al. | ..... | 190/108 |
| 5,580,157 | A * | 12/1996 | Patricca et al. | ..... | 362/191 |
| 5,683,022 | A * | 11/1997 | Evans | ..... | 224/583 |
| 6,244,400 | B1 | 6/2001 | Bowers | | |
| 6,851,826 | B2 * | 2/2005 | James | ..... | 362/156 |
| 2004/0090773 | A1 * | 5/2004 | Bryan | ..... | 362/156 |
| 2006/0096680 | A1 * | 5/2006 | Khubani et al. | ..... | 150/113 |

FOREIGN PATENT DOCUMENTS

| | | | |
|---|---|---|---|
| CH | 604604 A | * | 9/1978 |
| FR | 2879414 A | * | 6/2006 |

* cited by examiner

*Primary Examiner*—Sharon E Payne
(74) *Attorney, Agent, or Firm*—Robert Z. Evora

(57) ABSTRACT

A modular organizer system including a first pouch having an opening for securely receiving and positioning an item in a preferred position. A fastening mechanism is disposed on the first pouch and is adapted to modularly fasten a second pouch to the first pouch in any preferred orientation surrounding the first pouch. The modular organizer may be arranged within a carrying bag and molded to fit within an open compartment of the carrying bag. The modular organizer system can easily transfer the pouches with all of the contents from one carrying bag to another carrying bag.

24 Claims, 13 Drawing Sheets

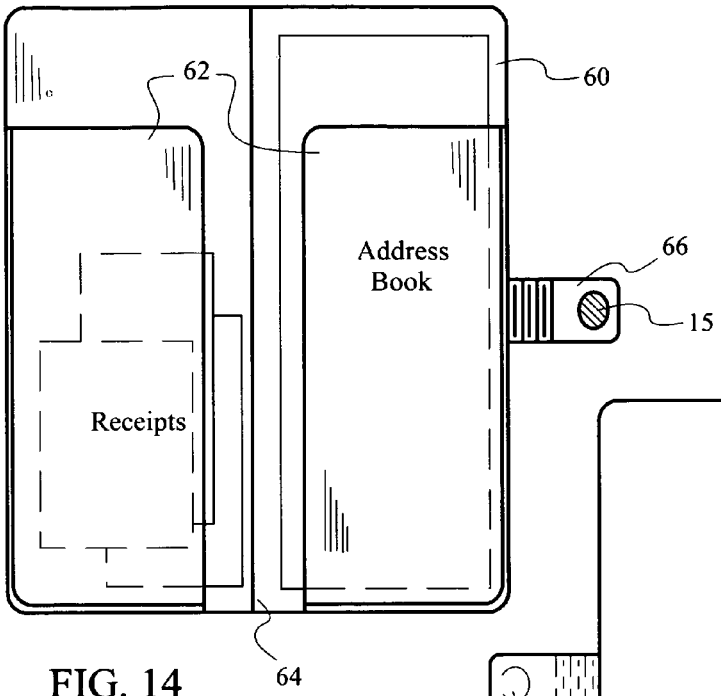
FIG. 14
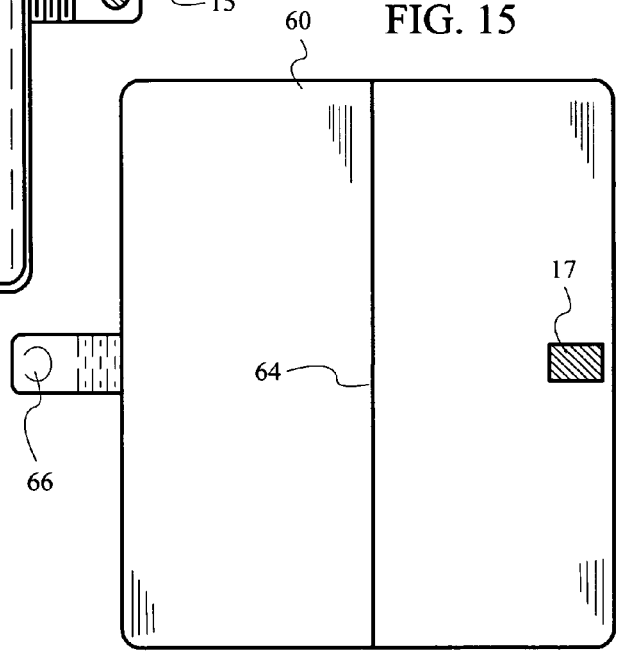
FIG. 15
FIG. 16
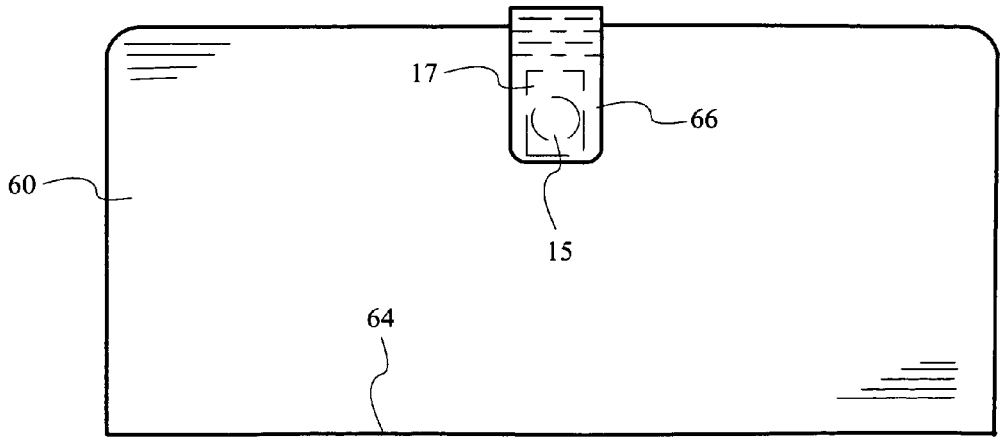

CARRY BAG MODULAR ORGANIZER SYSTEM

CROSS REFERENCE TO RELATED APPLICATION

This application is a Non-Provisional Application which claims the benefit of the filing date of U.S. Provisional Application Ser. No. 60/712,285, entitled "Carry Bag Modular Organizer System" filed Aug. 29, 2005, the entirety of which is incorporated herein by reference.

BACKGROUND OF THE INVENTION

1. Field of the Invention

The present invention relates to a customizable, removable organizer system for a tote type carrying bag, and in particular to a modular inner liner system that a person can tailor to his or her personal preferences for various carrying bags including: a briefcase, a handbag, a backpack, a gym bag, a diaper bag and other tote type bags.

2. Description of the Related Art

A variety of conventional inner liner devices have been previously contemplated. Some of these embodiments disclose a single piece "tool belt" inner liner having expandable pockets for various items, such as: keys, glasses, checkbook, makeup, cell phone, credit cards, pills and/or other personal items. The single piece tool belt sits inside a bag or purse and wraps within a single internal compartment of the purse leaving room in the middle for larger items, such a wallet. These inner liners are made from a predetermined single piece construction and are not modifiable in size and/or shape. When the single piece tool belt inner liner is moved from bag to bag, the entire tool belt is moved from one bag to the next bag. Each bag must be big enough to encase the prefabricated size of the single piece tool belt inner liner.

Other conventional devices include a one piece shell construction unit having a predetermined size that mimics the inner lining of a purse or bag. The one piece construction unit allows the user to put dividers into it to create internal compartments. This entire unit is slid into a handbag or the like. As one single unit, the inner liner is removed from one bag (with all of the contents intact) and dropped into another bag. However, the unit is not modular so the entire unit must fit within the shape of the internal compartment of the bag.

Attempts have been made to create a convenient portable inner liner that can be easily removed from one bag and stored in another bag. However, these conventional inner liners suffer from many disadvantages. For example, none of them anticipate that most carrying bags and purses have internal compartments separated by various partitions. The previous mentioned inner liner systems fail to maximize the internal space within a purse because they are contiguous and can only use one compartment, making the others useless. As such, much of the space in a carrying bag is used inefficiently.

Furthermore, it is not possible to customize each of the internal compartments within the carrying bag to the user's size and preference. To the contrary, the user must make use of the predefined compartments configured into the inner liner by the manufacturer.

SUMMARY OF THE INVENTION

An object of the present invention is to provide a customizable, modular removable organizer system for a bag, such as a tote type bag, a suitcase, diaper bag, briefcase, handbag, backpack, and/or other type of carrying compartment (hereafter "carrying bag").

Another aspect of this invention is to provide a modular organizer system including a first pouch having an opening for securely receiving and positioning an item in a preferred position. A fastener is disposed on the first pouch and is adapted to modularly fasten a second pouch to the first pouch in any preferred orientation about the first pouch. The modular organizer system may be arranged within an open compartment of a carrying bag. The fastening mechanism may be employed by the use of Velcro®, a magnet and the like.

The modular removable organizer system is easy to assemble within a carry bag and the contents thereof can easily be transferred from one carrying bag to another carrying bag.

Another objective of this invention is that the system according to this invention facilitates keeping the interior of the carrying bag in a clean and organized condition. The removable organizer system can be arranged to be molded to the interior shape of any compartment in a carrying bag.

The modular organizer system may be arranged as a plurality of pouches interconnected with each other and configured within any of the open compartments of a carrying bag so that the periphery of the pouches are molded to fit within the open compartments of a carrying bag.

Various features and/or additions may be integrated into the removable organizer system, such as a handle, an illumination source, an elastic band to affix additional items, and rigid dividers used to separate various items within the pouch. The removable organizer system may also include a billfold pouch capable of receiving flat elongated items.

Still another object of the present invention is to integrate an adapter device that may be used as an interconnecting cross-member between the various pouches.

According to another exemplary embodiment, a method for modularly organizing the contents of a carrying bag may be provided. The method may include providing a first pouch for receiving an item to be securely positioned within an open compartment of a carrying bag and modularly fastening at least a second pouch to the first pouch in any preferred orientation for receiving additional items. The items may be securely positioned in a preferred position so that they may be easily accessed from the opening of the carrying bag. The method can be expanded to include the arrangement of a plurality of pouches interconnected with each other and configured within an open compartment of a carrying bag so that the periphery of the pouches together is molded to fit within any open compartment of a carrying bag.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIGS. 14, 15 and 16 are exemplary illustrations of a document holder pouch according to this invention.

DETAILED DESCRIPTION OF EXEMPLARY EMBODIMENTS

Particular embodiments of the present invention will now be described in greater detail with reference to the figures.

This invention overcomes the conventional problems described above by providing a removable organizer system for a carrying bag. In accordance with this invention, the removable organizer system is modularly adaptable in construction and a user may configure the internal pouches within a carrying bag of any size to fit their user's specific needs.

This removable organizer system enables switching the contents from one carrying bag to another carrying bag conveniently and easy. One advantage is that the user will no longer forget items when the contents are transferred from one carrying bag to the next since all of the contents will be removed together from the first carrying bag and inserted into the second carrying bag as a single unit and not in individual pieces as was conventionally done. In addition, the removable organizer system is configured in the carrying bag so that all of the contents within the carrying bag can be easily seen from the opening of the carrying bag. Thus, it is not as easy to lose or misplace smaller items, such as keys, make-up, and the like within a carrying bag.

Figure 1A:
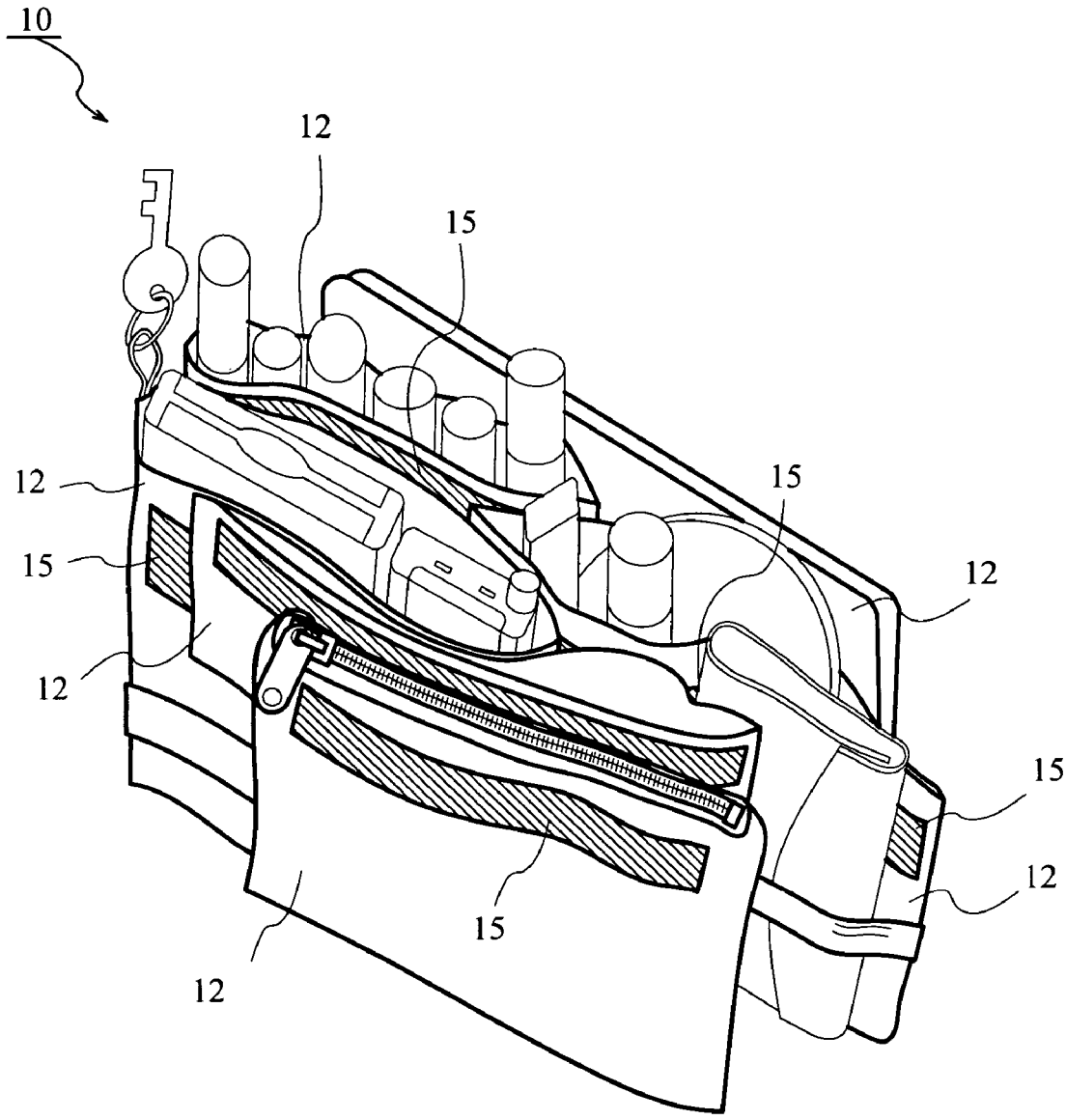
FIG. 1*a* is an illustration of a modular removable organizer system according to this invention.

FIG. 1*a* is an exemplary illustration of a modular removable organizer system 10 according to this invention. The removable organizer system 10 shows a variety of pouches 12 removably connected to each other by a system of fasteners 15 which will be described in more detail later. The various pouches 12 are arranged in a compact modular arrangement.

Figure 1B:
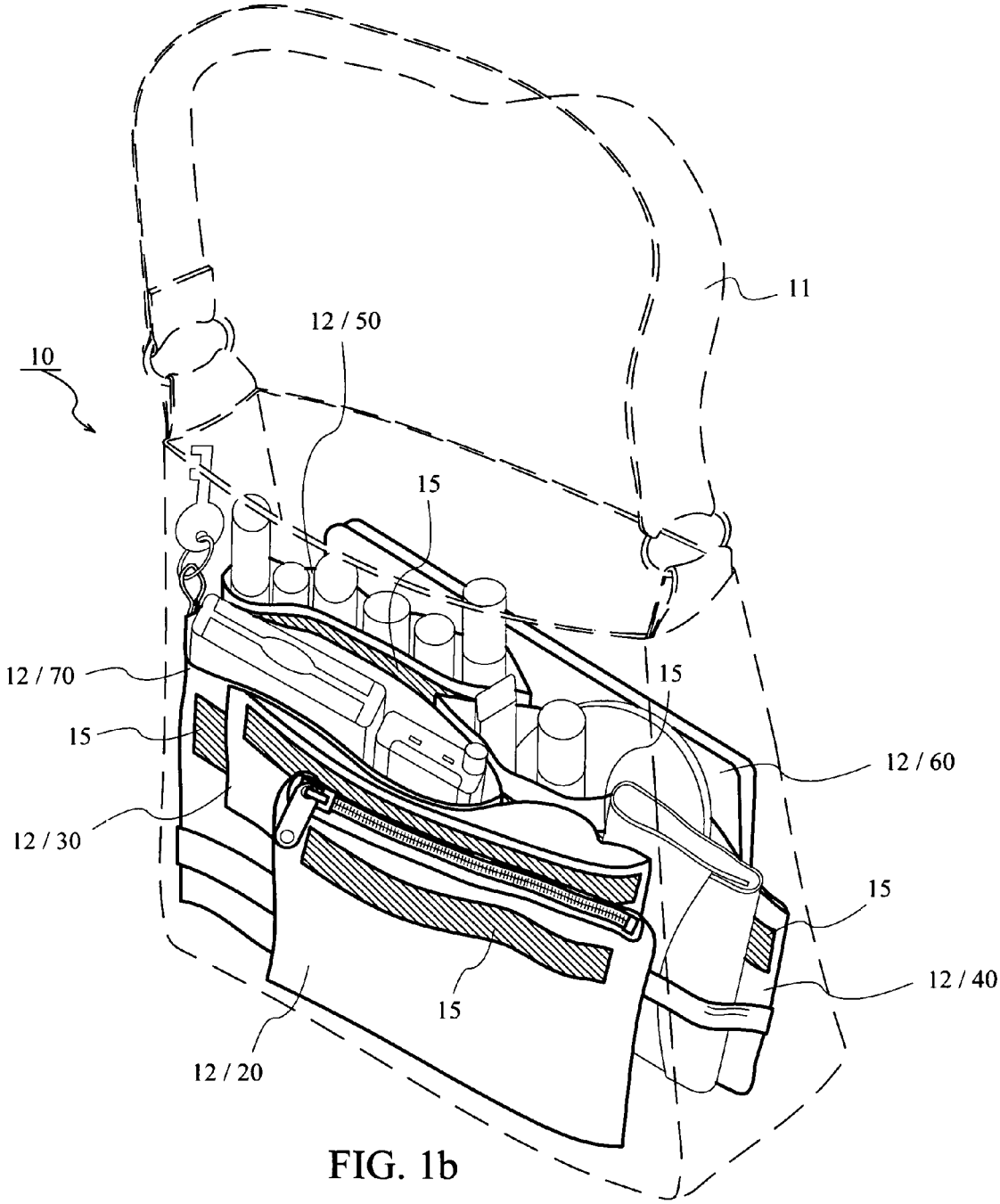
FIG. 1*b* is an illustration of a modular removable organizer system disposed within a carrying bag according to this invention.

FIG. 1*b* is an illustration of a modular removable organizer system 10 disposed within a carrying bag 11. According to this embodiment, the carrying bag 11 is a purse. As shown and will be described, the removable organizer system 10 is modular and the pouches 12 that make up the removable organizer system 10 can be arranged within a carry bag in a variety of different modular orientations. In particular, FIG. 1*b* shows an arrangement for a privacy pouch 20, an elongated pouch 30, an essential pouch 40, an alternative essential pouch 70, a divider pouch 50 and a document pouch 60. Each of these various pouches privacy pouch 20, 30, 40, 50, 60, 70 will be discussed in more detail later.

The removable organizer system 10 is lightweight, durable and may be made of a material that is washable. The removable organizer system 10 may also be used for a variety of different applications and can be configured for any size or shape carrying bag, such as for example: a purse having various partitions, a suitcase, a gym bag, a backpack, a briefcase, a diaper bag, a handbag, a computer bag, a tote, a beach bag, a basket, a satchel, a valise, a sac and the like. This invention is not limited for use in a carrying bag and also may be used for a variety of other applications including in a stow-away, a drawer, a desk organizer or the like.

Figure 2:
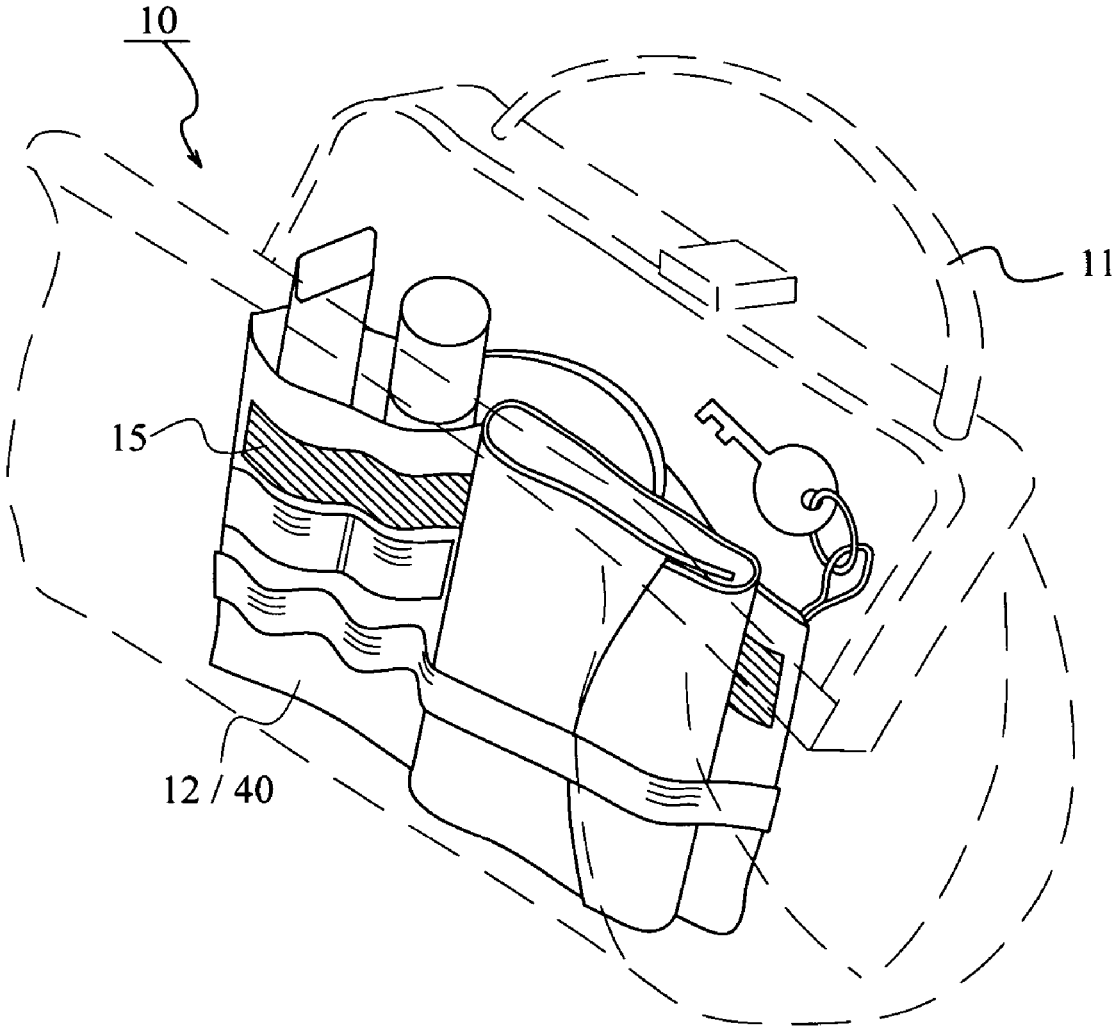
FIG. 2 is an illustration of the modular removable organizer system consolidated to fit within a smaller carrying bag according to this invention.

FIG. 2 illustrates that the removable organizer system 10 may be configured for virtually any size carrying bag such as in this embodiment which shows a smaller carrying bag 11, such as a clutch. As shown, the clutch is smaller and accommodates less interior space. Suppose for example, a person is going to be carrying the clutch on an evening out and it is not possible to fit all of the contents in the purse shown in FIG. 1*b* into the clutch shown in FIG. 2. Instead of bringing all of the contents of the carrying bag 11 shown in FIG. 1*b*, she may opt for carrying only a few of her essential items that can be carried in a single essential pouch 40, such as lipstick, lip gloss, compact, wallet and keys. The user can easily detach the essential pouch 40 from the removable organizer system 10 shown in FIG. 1*b* and transfer the essential pouch 40 into the smaller clutch. Likewise, later she can easily transfer the essential pouch 40 from the clutch and reattach back into the carrying bag 11 shown in FIG. 1*b*.

Figure 3:
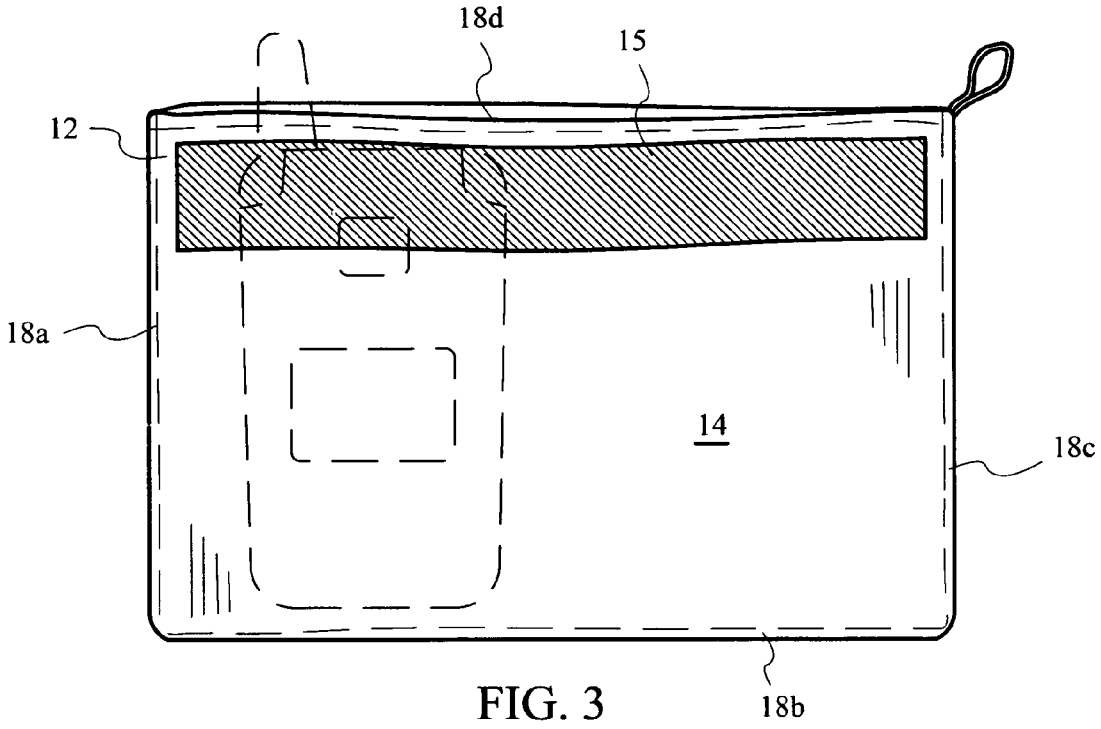
FIG. 3 is a front view of an exemplary illustration of a pouch according to this invention.
Figure 4:
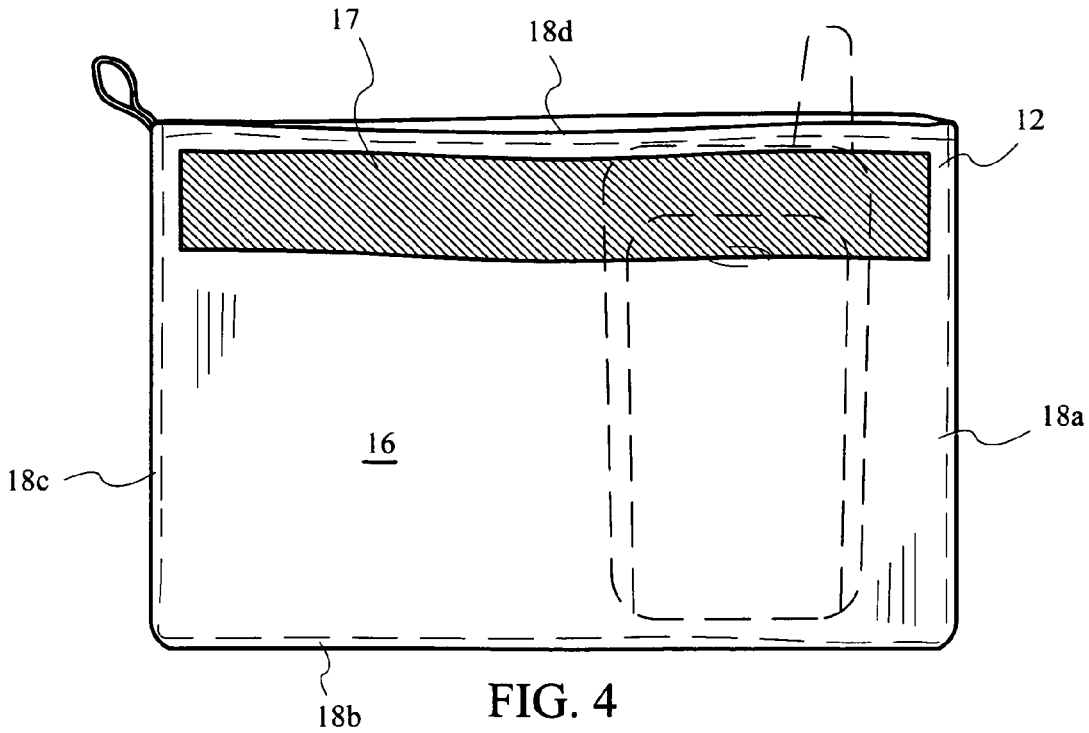
FIG. 4 is a rear view of the exemplary illustration of the pouch according to this invention.

FIGS. 3 and 4 illustrate the basic design for a pouch 12. The pouch can be designed to have a variety of sizes (length, width, height) so that the pouch 12 can maximize the use of space within the carrying bag. The pouch 12 may be designed to hold items of various sizes and shapes, such as: keys, glasses, makeup, cell phone, credit cards, pills, wallet, checkbook, date book, writing utensils, cash, change, pen and/or lipstick holder, hairbrush, sunglasses, a PDA, a notebook and/or other personal items in accordance with this invention. The removable organizer system 10 also serves to protect valuable items, such as various electronics, including a cell phone, ipod, PDA, and/or fragile items, such as glasses, jewelry or the like.

The pouch 12 of the removable organizer system 10 is configured to keep the contents within the carrying bag 11 standing upward and visible and within plain sight to the user when viewed through the opening of the carrying bag 11 as shown in FIG. 1*b*. Thus, the contents in the carrying bag 11 are disposed upright and at fingertips of the user. According to this arrangement, it is easy to locate items within the carrying bag 11, as well as to retrieve them from and reposition the items in and out of their respective pouches 12. The removable organizer system 10 allows the user to keep the contents of their carrying bag arranged neat and accessible.

The pouch 12 may be made of a substantially rigid and narrow construction. The objective would be to have enough rigidity to position the items within the pouch 12 upright. The rigidity in the pouch 12 also provides additional stability and support for soft-sided carrying bags 11. The pouch 12 may be flexible and individually detachable and cooperatively mold to the inside compartment(s) of the user's carrying bag 11. The removable organizer system 10 is configured to fit within the carrying bag 11 so that all of the various compartments within the carrying bag 11 may be maximized as shown in FIG. 1*b*.

The pouches 12 are interlocked to each other via a fastening mechanism. A variety of fastening mechanisms that are currently known or later developed may also be used in accordance with this invention. For example, the fastening mechanism may include Velcro®, snaps, magnets, adhesive, straps, and/or any other method for fastening the series of pouches 12 to each other at an infinitesimal number of positions relative to each other.

FIGS. 1, 2, 3 and 4 show a "hook and eye" mechanism being employed as the preferred mechanism for fastening the pouches 12 according to this embodiment. As conventionally known in the art, Velcro® also includes a "hook and eye" mating arrangement. For simplicity, the "hook portion" will be referred to as the male hook portion 15 and the "eye portion" will be referred to as the female eye portion 17.

Referring back to FIGS. 3 and 4, FIG. 3 shows a front view of a pouch 12 and FIG. 4 shows a back view of the pouch 12. The basic design for a pouch 12 includes a first side 14 (FIG. 3) having a male hook portion 15 and a second side 16 (FIG. 4) including a female eye portion 17. The first side 14 and the second side 16 of the pouch 12 are attached to each other at adjoining edges 18*a*, 18*b*, 18*c* such that one edge 18*d* of the pouch 12 is open to receive the contents of the pouch. The first side 14 and the second side 16 of the pouch 12 may be attached to each other in a variety of different methods. In particular, the first side 14 and the second side 16 of the pouch 12 may be sewn together at least three of the edges 18*a*, 18*b*, 18*c* leaving the upper edge 18*d* facing upward toward the carrying bag opening to receive the items disposed within the pouch 12. Alternatively, the edges 18*a*, 18*b*, 18*c* may be secured to each other by an adhesive and/or any other method for fastening that is now known or later developed in accordance with this invention.

The male hook portion 15 and female eye portion 17 may be arranged and disposed anywhere on the pouch 12. As shown in FIGS. 3 and 4, the male hook portion 15 and female eye portion 17 may be disposed across a top portion of the pouch 12.

Figure 5A:
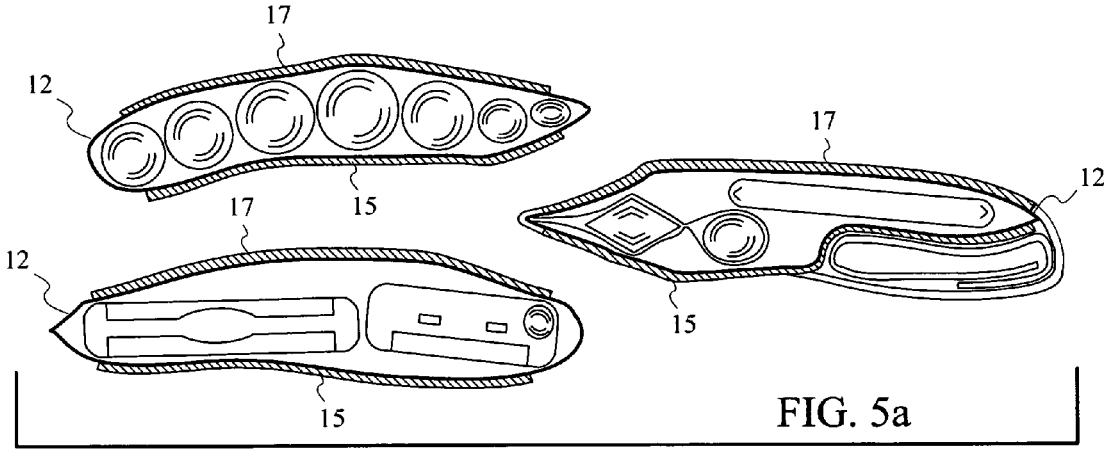
FIG. 5*a* is a top view of a plurality of pouches according to this invention.
Figure 5B:
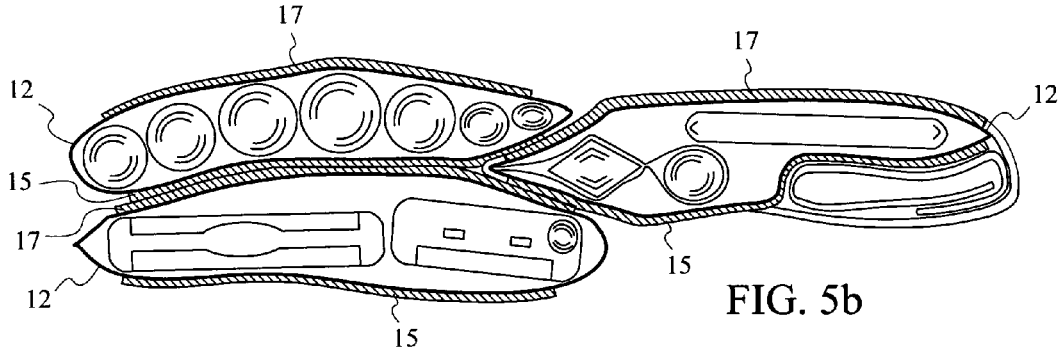
FIG. 5*b* is a top view of the pouches of the removable organizer system arranged in a staggered configuration according to this invention.
Figure 5C:
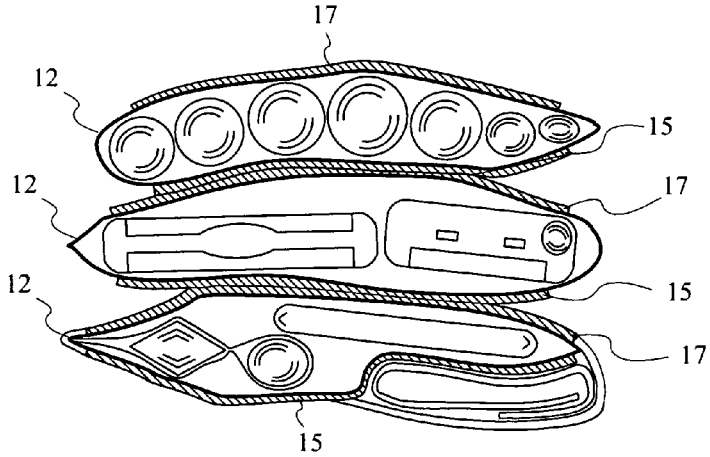
FIG. 5*c* is a top view of the pouches of the removable organizer system arranged in a side-by-side configuration according to this invention.

FIGS. 5*a*, 5*b* and 5*c* illustrate the manner in which the various pouches 12 may be modularly arranged relative to each other according to a user's preference. FIG. 5*a* shows three pouches 12 aligned for assembly to each other. As mentioned previously, the pouches 12 may be arranged in an infinitesimal number of positions relative to each other as desired by the user.

FIG. 5*b* shows fastening of the pouches 12 in a staggered configuration and FIG. 5*c* shows the pouches 12 arranged in an alternative side-by-side configuration.

In assembly, the various pouches 12 of the removable organizer system 10 are paired together so that a male hook portion 15 disposed on a first side of a pouch 12 is meshed, or joined together, with one or more female eye portion 17 disposed on a second side of a second pouch 12. Any number of pouches 12 may be clustered together by the user to mold to the interior space of the carrying bag 11 to maximize the use of the volume within the carrying bag 11.

The pouch 12 may be fabricated from a variety of now known or later developed materials having semi-rigid properties so that when items are placed within the various pouches 12 they are propped upright. Unlike conventional inner liner designs, the contents within the carrying bag 11 of this invention may be secured in a preferred position within each of the pouches 12 according to an arrangement designed specifically by the user. Some of the materials may include for example: a polymer, nylon, a thick gauge vinyl, and any other material now known or later developed in accordance with this invention.

Another aspect of this invention is to construct the pouches 12 from a transparent material. The advantage of using the transparent material is that it is easy to readily see the contents in each of the pouches 12. Thus, it is easy for a user to find any item stored within a pouch 12 of the removable organizer system 10. In the alternative, the pouches 12 may be made of, or externally lined with, an outer layer, such as a material fabric on which an aesthetic pattern or logo may be affixed.

The removable organizer system 10 promotes longer use to the user's carrying bag by protecting the inner lining of a carrying bag. Oftentimes, hi-end designer carrying bags can be very expensive; thus preserving the inner lining of these expensive carrying bags is highly desired. All too frequently various items are broken and/or unintentionally opened within a carrying bag that can destroy the inner lining of the carrying bag, and oftentimes the carrying bag itself. Some of those items that can damage a carrying bag include: melted lipstick, crumbly face powder, ink pens, leaking nail polish, a broken pen, opened snacks, candy or bubble gum, and any other item capable of soiling the carrying bag.

Furthermore, the pouches 12 may be designed to be water resistant to prevent products that soil the internal compartment of a pouch 12 from leaking out onto the inner lining of the carrying bag 11. Thus, the inner lining of a carrying bag 11 employing this invention may be substantially protected from being stained or soiled and/or permanently damaged. As such, the life span and use of the carrying bag 11 will be drastically increased and protected from damage. Another advantage of this invention is that it is easier to clean out the pouches 12 of the modular removable organizer system 10 than it is to clean out the soiled interior compartments of a carrying bag 11.

According to this invention, a variety of pouches 12 may be constructed depending on the purpose for which the particular pouch is intended. For example, where more privacy is desired, a privacy pouch may be used to conceal private contents that the user wishes to keep hidden from others who may glance into their carrying bag 11 when it is opened.

Figure 6:
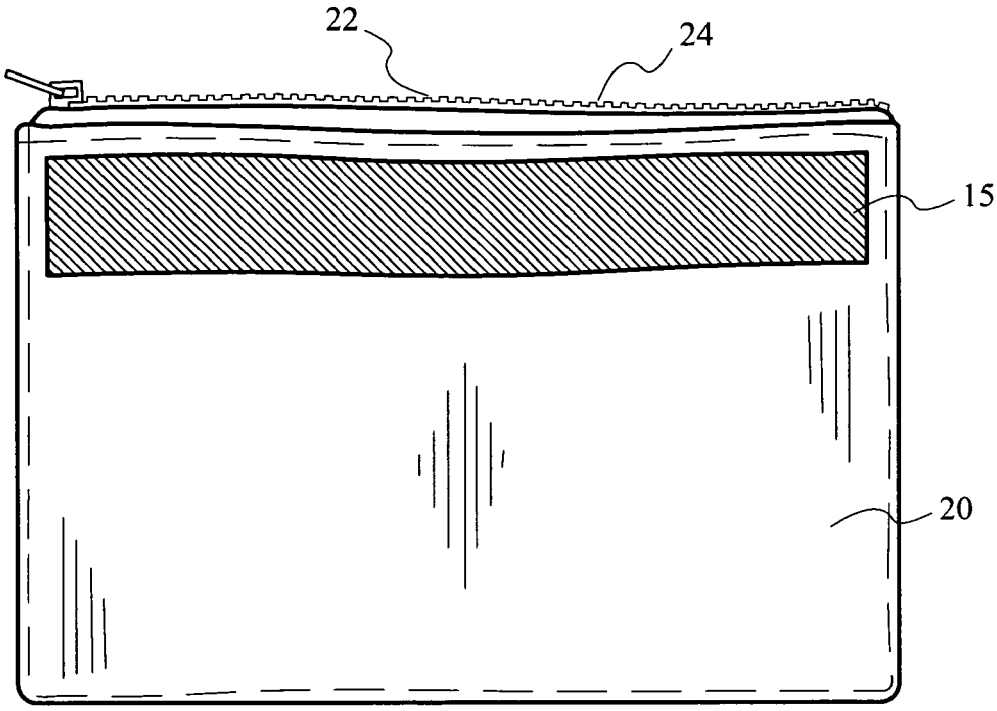
FIGS. 6 and 7 are exemplary illustrations of a privacy pouch according to this invention.
Figure 7:
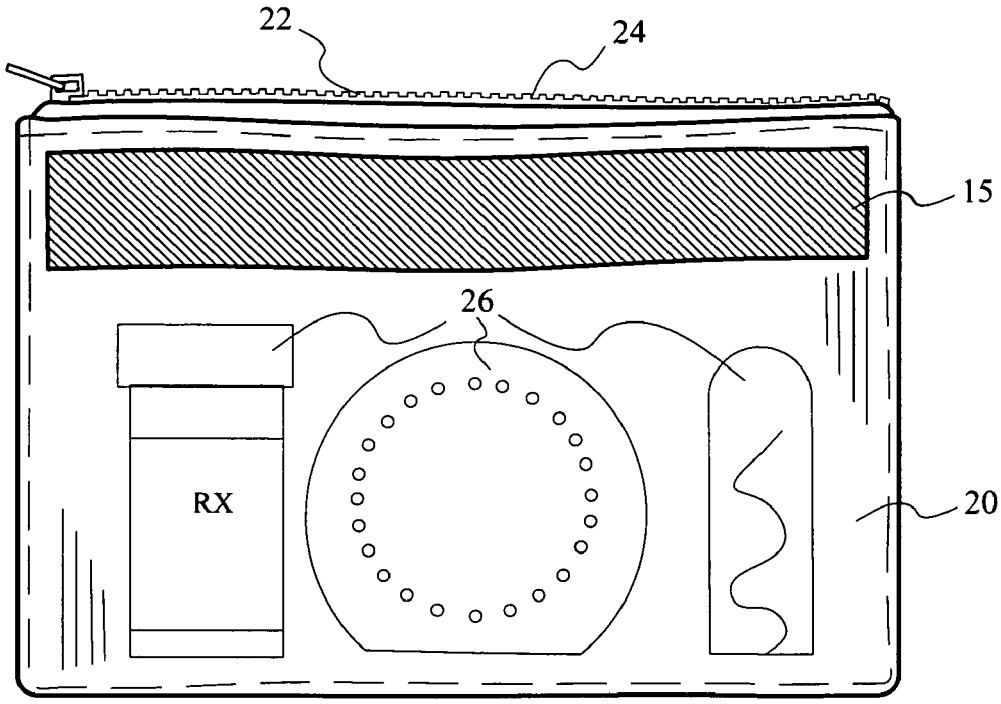

FIGS. 6 and 7 show an exemplary illustration of a privacy pouch 20. The privacy pouch 20 is similar in construction to the pouch 12 described above in FIGS. 3 and 4. The privacy pouch 20 may also include a closure mechanism 22 to prevent others from viewing the private contents 26 within the carrying bag 11. According to this embodiment, the closure mechanism is a zipper 24 disposed at a top end of the privacy pouch 20 to secure and shield the contents in the privacy pouch 20 from view. Various other closure mechanisms may be employed, such as for example, a zip-lock type attachment, snaps, magnets and any other now known, or later discovered mechanisms for closing the privacy pouch 20 and securing the items therein.

Figure 8:
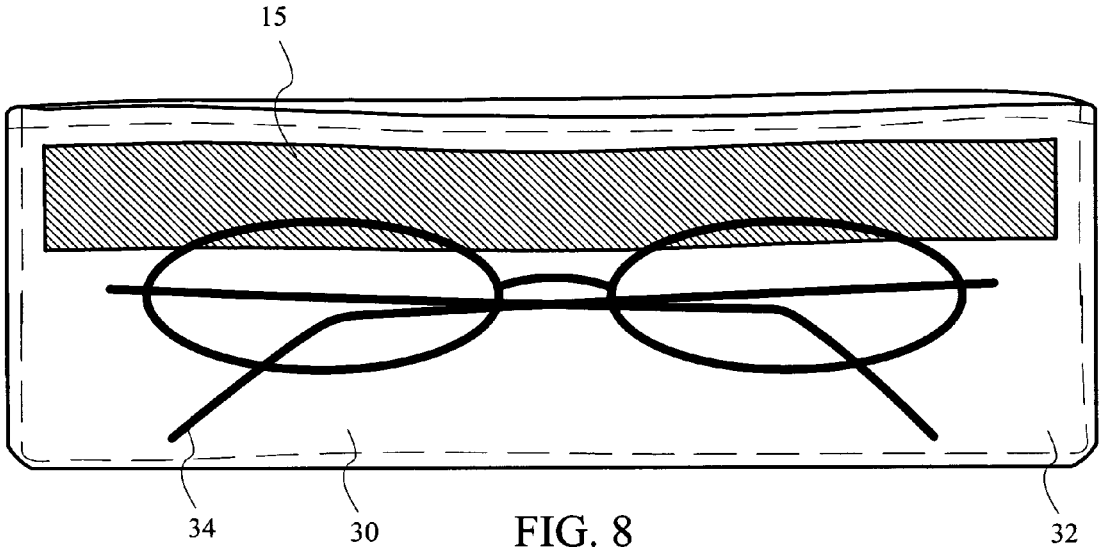
FIGS. 8 and 9 are exemplary illustrations of an elongated pouch according to this invention.
Figure 9:
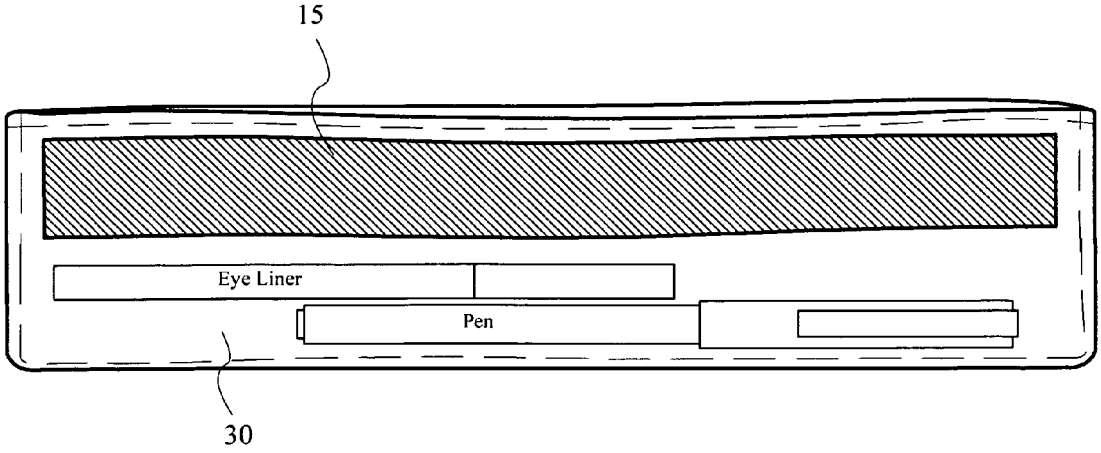

FIGS. 8 and 9 show an elongated pouch 30 that can be used for a variety of purposes. In general, the elongated pouch 30 may be used to suitably carry longer and narrow items. For exemplary purposes, FIG. 8 shows the elongated pouch 30 adapted to carry a pair of eyeglasses 34. The elongated pouch 30 may be inner lined with a soft material 32 to protect the glass lenses from being scratched. Other delicate items may be carried by the lined elongated pouch 30.

FIG. 9 shows the elongated pouch 30 being used to hold a pen and eye liner. The elongated pouch 30 may be used for a variety of purposes including carrying a writing utensil, make-up embodied in a thin tube, a thumb drive and/or any other item that may be long and thin.

Figure 10:
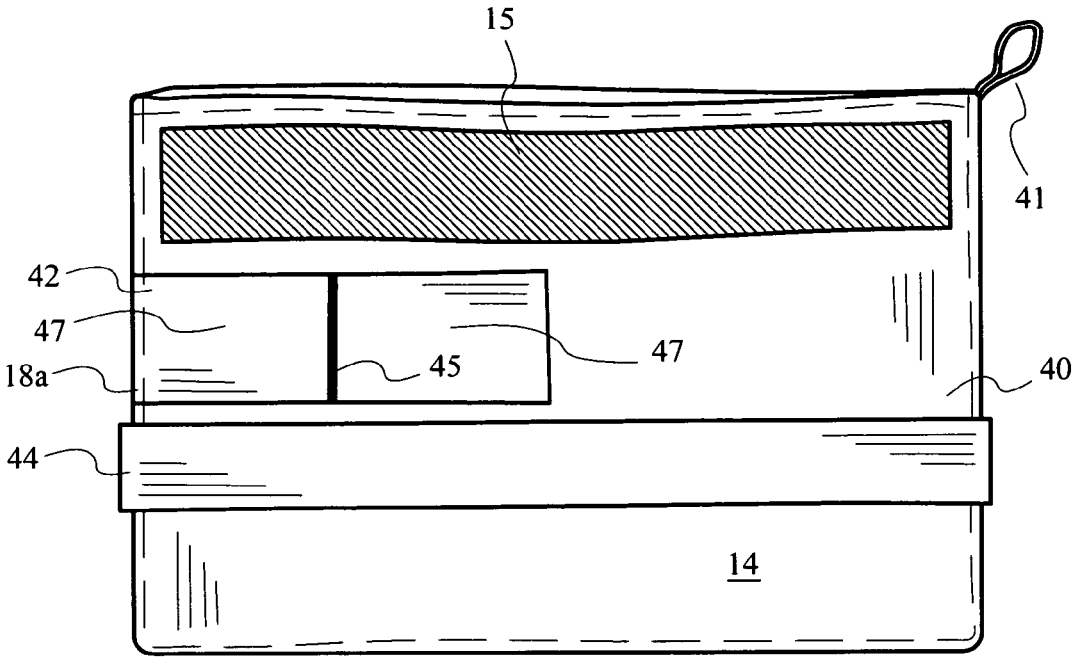
FIGS. 10 and 11 are exemplary illustrations of an essential pouch according to this invention.
Figure 11:
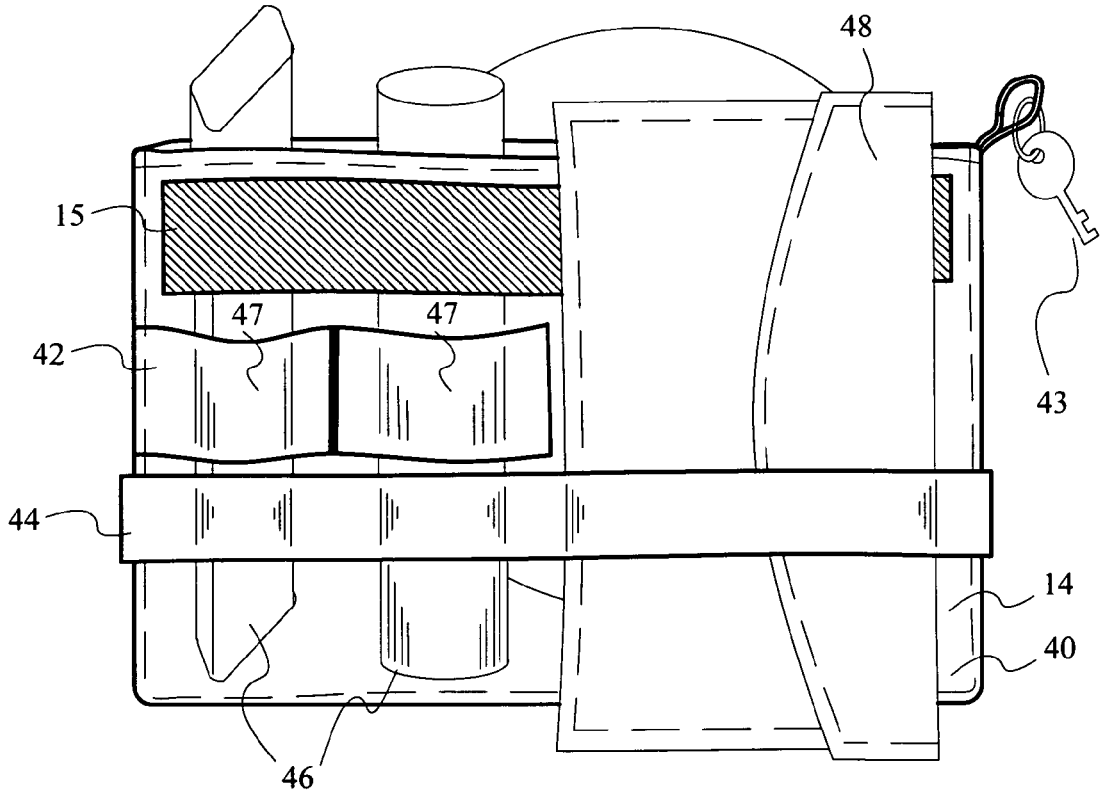

FIGS. 10 and 11 show another exemplary embodiment for a pouch, hereinafter named an essential pouch 40. As shown, the essential pouch 40 includes a loop 41, a male hook portion 15, a divider 42 and an elastic band 44.

The loop 41 may be an eye-let and/or any other type of quick-release mechanism for receiving and securing keys and/or other items. A key 43 is shown attached to the loop 41 at a corner of the essential pouch 40. The loop 41 may be employed as a magnet and/or any other type of quick-release mechanism that is now known or later developed in accordance with this invention.

The divider 42 may be integrated into the essential pouch 40 in a plurality of different methods. The divider 42 may be attached to a first edge 18*a* and extend into the essential pouch 40. The divider 42 may be attached to the first edge 18*a*, such as for example, by being sewn into the essential pouch 40. The divider 42 may include at least one seam 45 that separates a pair of openings 47 disposed to receive items within the essential pouch 40. Various methods for employing the divider 42 may be implemented. For example, the openings 47 of the divider 42 may be individually disposed throughout the essential pouch 40 via an adhesive and/or any other method for fastening. As shown, the dividers 42 may be used to hold lipstick 46 and/or any other type of item upright.

Figure 12:
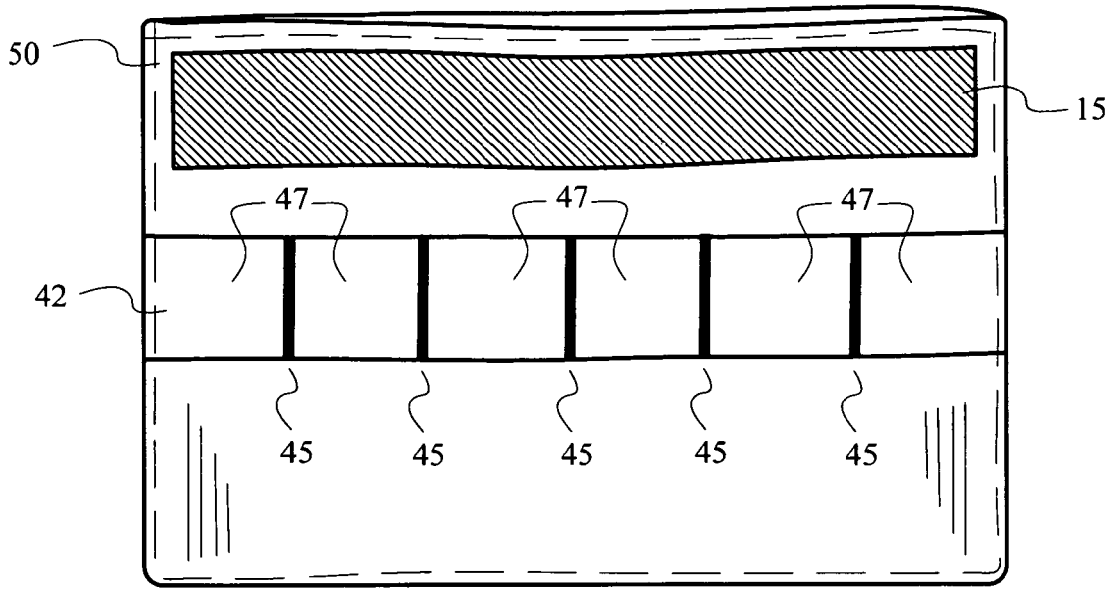
FIGS. 12 and 13 are exemplary illustrations of a divider pouch according to this invention.
Figure 13:
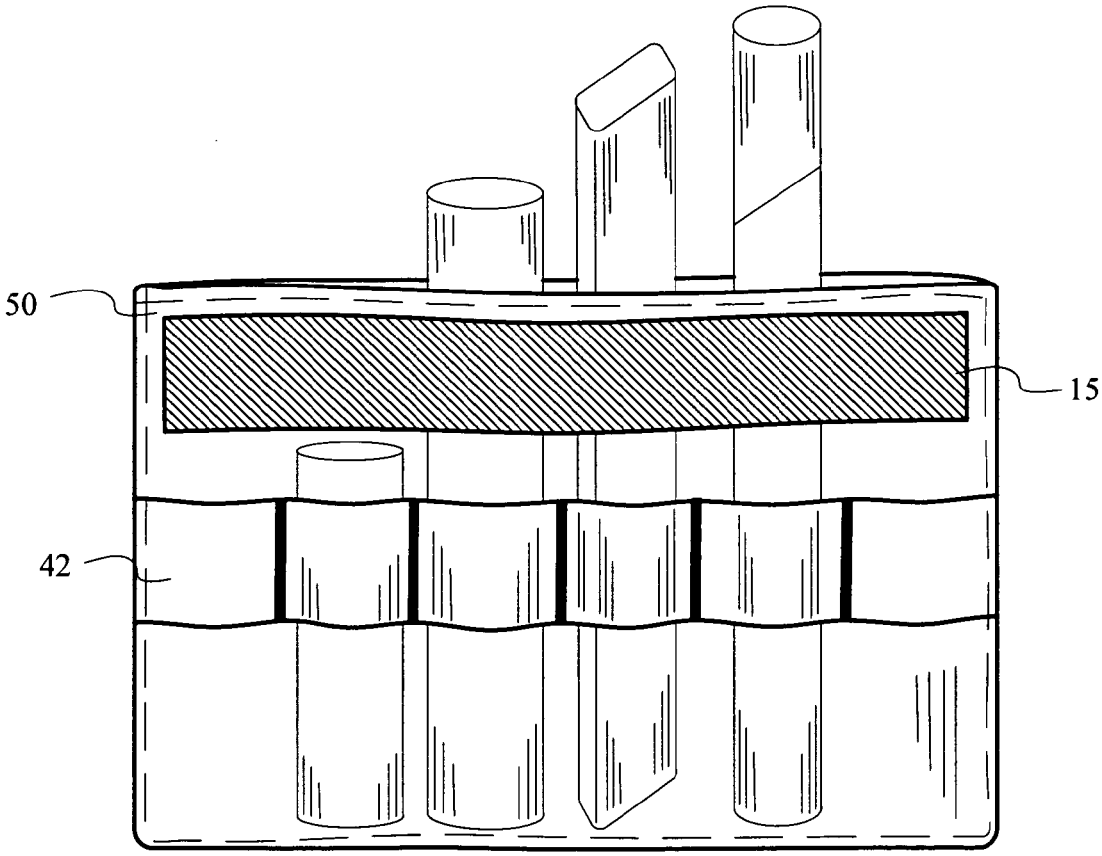

FIGS. 12 and 13 illustrate another exemplary embodiment for a divider pouch 50. According to this embodiment, the divider 42 is disposed across the entire length of the divider pouch 50. The divider pouch 50 may include a plurality of seams 45 that separate numerous openings 47. As shown in FIG. 13, the openings 47 are disposed to receive various items within the divider pouch 50.

Referring back to FIGS. 10 and 11, an elastic band 44 may be integrated into the essential pouch 40 to secure other items, such as a wallet 48 to the essential pouch 40. Although shown encircling the lower end of the essential pouch 40, the elastic band 44 may be functionally attached anywhere on the essential pouch 40 to span across at least one side of the essential pouch 40. As shown, the elastic band 44 secures the wallet 48 to the essential pouch 40 between a first side 14 of the essential pouch 40 and the elastic band 44.

FIG. 1*b* also illustrates an alternative essential pouch 70 configuration. According to this exemplary embodiment, the alternative essential pouch 70 includes internal space for storing various items including a compact and a cellular phone.

As illustrated, the features and functionality disclosed in the various exemplary features described in each of the pouch embodiments described above may be used interchangeably. For this reason, at least the loop 41, the divider 42, the zipper 22, the elastic band 44 and the closure mechanisms 22, 66 (described later) may be incorporated as part of any of the pouches 12 that make up the removable organizer system 10.

FIGS. 14, 15 and 16 illustrate a pouch being configured as a document holder pouch 60. The document holder pouch 60 is adapted to hold flat documents, such as for example: a checkbook, an address book, receipts, dollar bills, and other miscellaneous, flat items. This document holder pouch 60 may include flaps 62 to secure the various documents and/or items within the document holder pouch 60. The document holder pouch 60 may include a seam 64 at which position the document holder pouch 60 is folded. The two halves of the document holder pouch 60 are secured to each other by a closure mechanism 66. The closure mechanism 66 may be composed of a male hook portion 15 (FIG. 14) that attaches to a female eye portion 17 (FIG. 15) when the document holder pouch 60 is folded in half as shown in FIG. 16. As shown in FIG. 1*b*, the document holder pouch 60 may lay sideways adjacent to the other pouches 12. The document holder pouch 60 may also include an additional hook and eye attachment for securing it to the other pouches 12 as shown and discussed later in FIG. 18.

Another advantage of this removable organizer system 10 is that it may be used in a carry bag having a deep compartment where the width of the carrying bag is preferably minimized.

Figure 17:
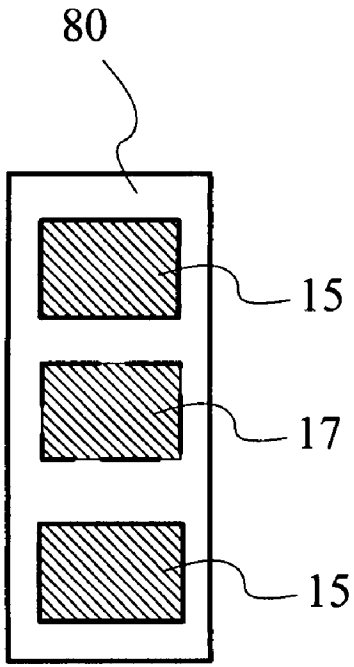
FIG. 17 is an exemplary illustration of an adapter element according to this invention.
Figure 19:
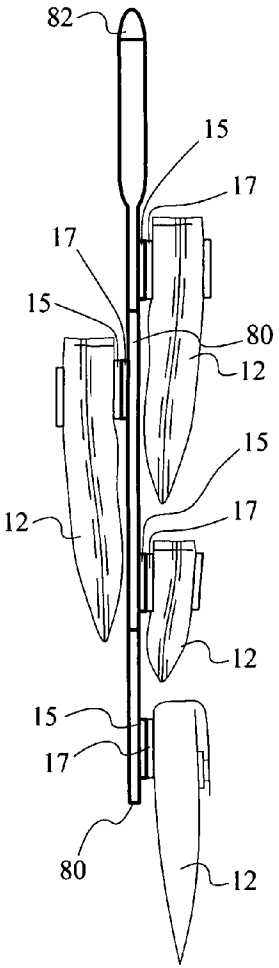
FIG. 19 shows a side view of the plurality of pouches in a stacked configuration according to this invention.
Figure 18:
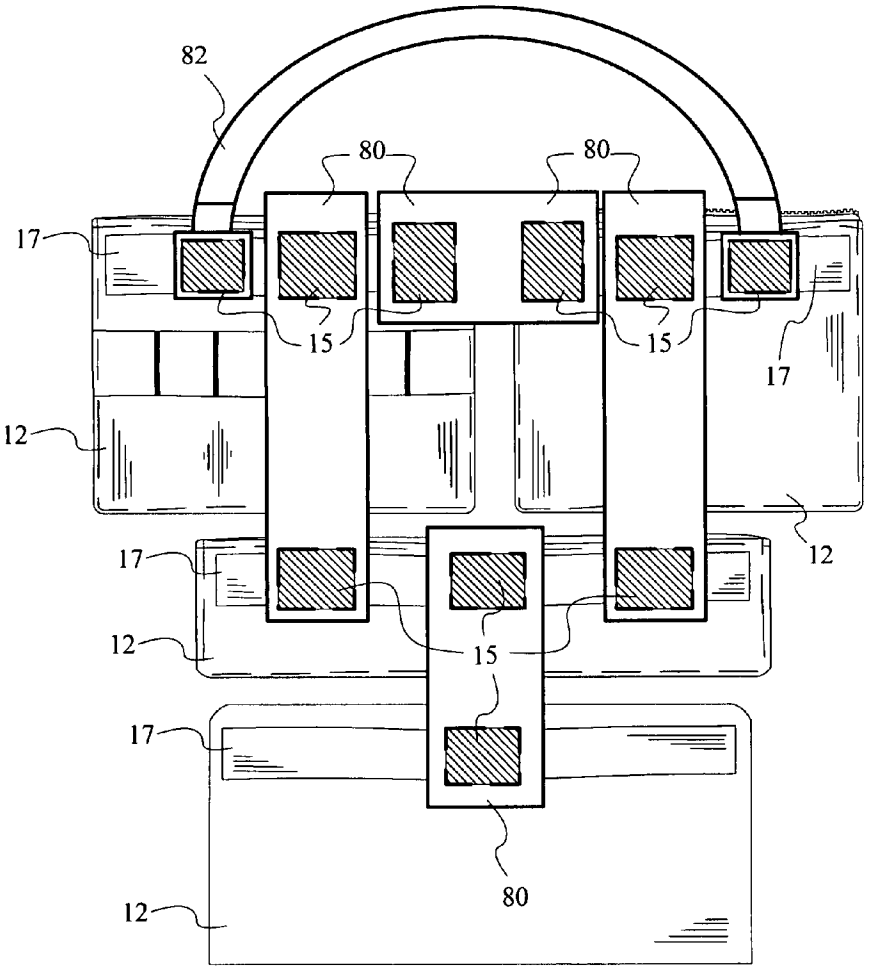
FIG. 18 illustrates using the adapted to configure a plurality of pouches in a stacked configuration according to this invention.

FIGS. 17, 18 and 19 illustrates another aspect of the invention to solve this problem. According to this exemplary embodiment, the removable organizer system 10 includes an adapter element 80. The adapter element 80 is tailored to allow the various pouches to be disposed in a stacked arrangement. The stacked arrangement is useful for various types of carrying bag configurations, such as a computer bag, a diaper bag, and a suitcase, where more depth is available and where it may be more convenient to arrange the pouches 12 in various stacked levels (as opposed to a staggered or side-by-side arrangement as shown in FIGS. 5*a*, 5*b*, 5*c*) to keep the width of the carrying bag 11 at a minimum.

FIG. 17 shows the adapter element 80 defined as a rigid sheet of material including at least one of a male hook portion 15 and a female eye portion 17. In FIG. 17, the female eye portion 17 is shown in hidden line to illustrate that it is disposed backward facing on the back side of the adapter element 80. Likewise, as shown in FIG. 18, the male hook portions 15 are illustrated backward facing for attachment to the female eye portions 17 on each of the various pouches 12. The adapter element 80 may be disposed vertically or horizontally to secure the stacked arrangement as shown in FIG. 18.

FIGS. 18 and 19 illustrates the pouches 12 arranged in a stacked configuration. In assembly, the male hook portion 15 of the adapter elements 80 is attached to a female eye portion 17 of a pouch 12. Likewise, the female eye portion 17 of the adapter element 80 may be attached to a male hook portion 15 of another pouch 12. The user can decide how to configure the removable organizer system 10 in any desired arrangement. As shown in FIG. 19, the pouches 12 may be attached to both sides of the adapter element 80.

In the alternative, the adapter element 80 may be embodied as a large rigid sheet including a plurality of male hook portions 15 and female eye portions 17 that may be disposed on the rigid sheet in any desired configuration chosen by the user. As such, the user can organize the removable organizer system 10 in a stacked arrangement to accommodate a predetermined compartment size to store various items within a carrying bag 11.

Various component parts can be designed in accordance with the removable organizer system 10. For example, a handle 82 may be integrated for use with various pouches 12 in the removable organizer system 10 as shown in FIG. 18. The handle 82 will assist in moving, carrying, and hanging the removable organizer system 10. Alternatively, the handle 82 may be adapted to fit a single pouch 12. The handle 82 is a convenient alternative that will enhance the user's ability to transport the removable organizer system 10 from one carrying bag 11 to another carrying bag 11. FIG. 18 shows the handle 82 being attached by a male hook portion 15 to the female eye portion 17 of the pouch 12.

Figure 20:
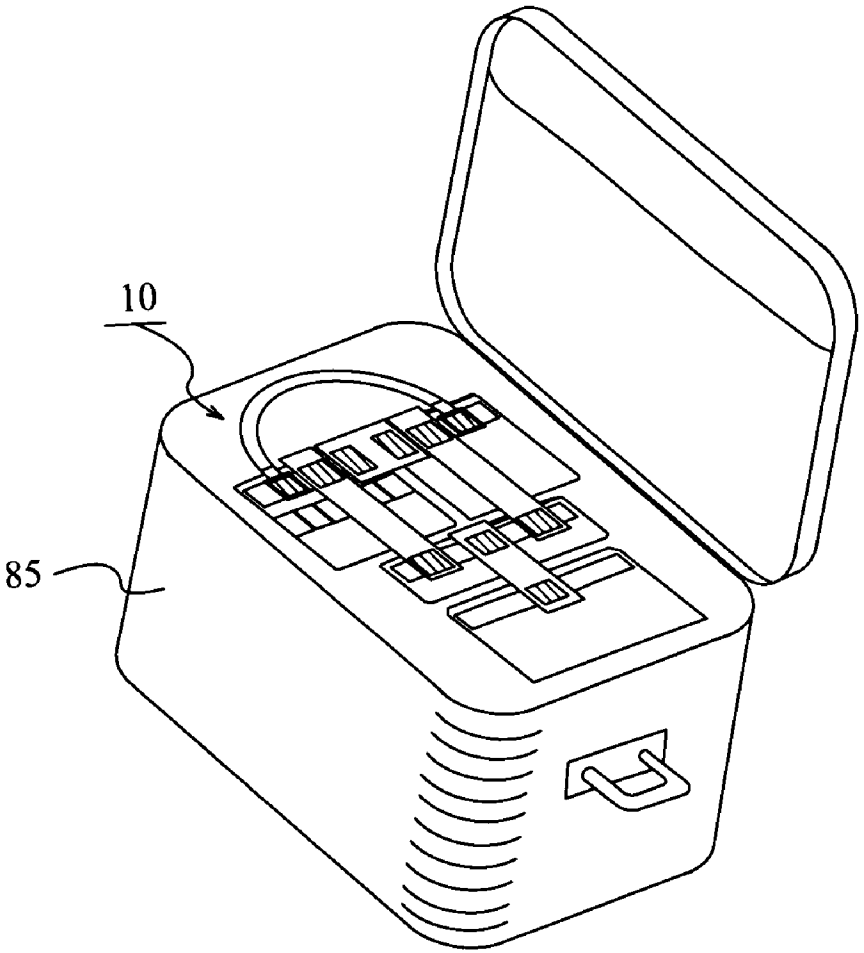
FIG. 20 illustrates the removable organizer system conveniently stored for travel in a suitcase according to this invention.

FIG. 20 illustrates the convenience that travelers can benefit from the use of a handle 82 being integrated onto the removable organizer system 10. For example, in a hotel, the traveler can simply lift the removable organizer system 10 from their suitcase 85 and hang it in the bathroom. All of the user's personal items will be easily accessible and neatly arranged for use. When the traveler is ready to leave, he or she can merely lift the removable organizer system 10 by the handle 82 from the place that it is hanging and pack it back into the suitcase 85. This is very convenient to a traveler because the traveler no longer has to individually pack and unpack each of their personal items from their suitcase 85 and arrange them in a convenient location for use; which frequently happens to be on the bathroom sink counter. The user can configure specific pouches to hold specific items for different rooms, such as for example a set of pouches configured to hold shower items, such as shampoo, conditioner, body soap, lotion, etc. In the hotel, the traveler can detached the shower items with the handle 82 and hang the shower items in the bathroom for use there.

Figure 21:
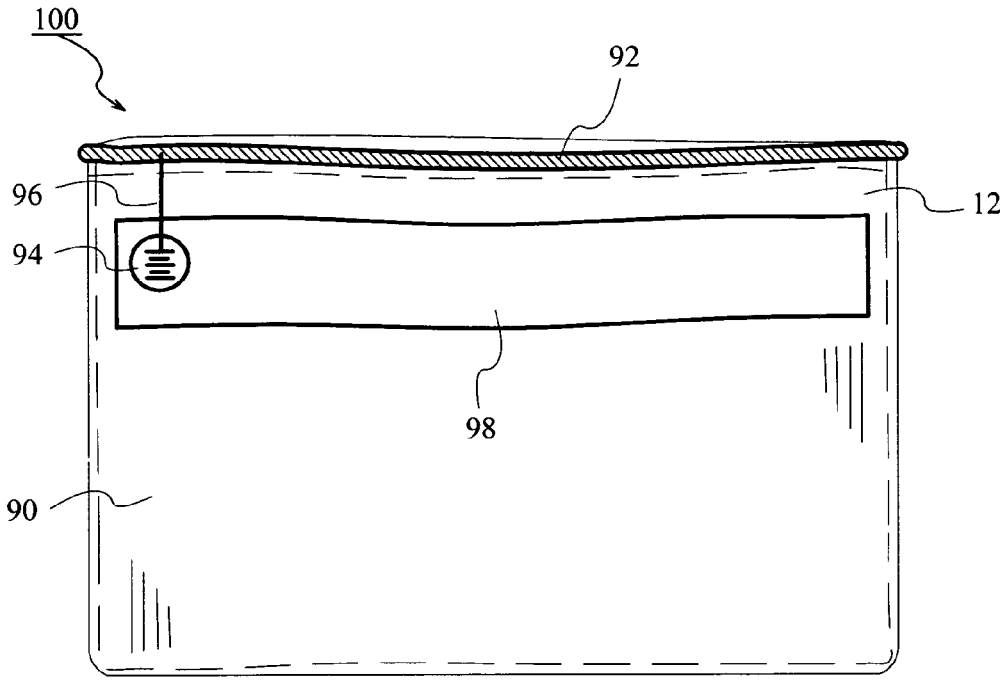
FIG. 21 shows an illumination pouch including a power source according to this invention.
Figure 22:
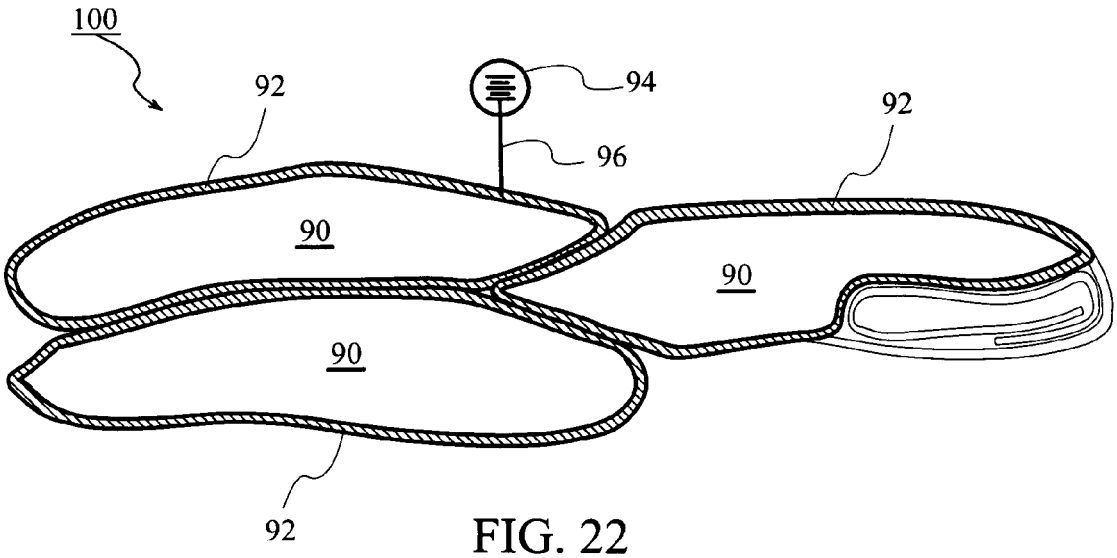
FIG. 22 is an illustration of various illumination pouches in an illuminating removable organizer system according to this invention.

FIGS. 20 and 21 shows yet another exemplary embodiment for an illuminating removable organizer system 100 including at least one illumination pouch 90. The advantage of the illuminating removable organizer system 100 is that a user can look into their carrying bag in dark or dimly lit surroundings.

In particular, FIG. 20 shows the illumination pouch 90 including a fiber optic element 92 integrated as part of the illumination pouch 90. The fiber optic element 92 may be electrically connected through a wire conductor 96 to a replaceable power source 94.

FIG. 21 shows the illuminating removable organizer system 100 composed of a plurality of illumination pouches 90 attached to each other in a staggered arrangement. As shown, the illumination pouches 90 are electrically connected to each other so that the power source 94 effectively illuminates all of the fiber optic elements 92 lining the illumination pouches 90.

An electrical connection may be made through the strips 98 disposed on the various illumination pouches 90. That is, the strip 98 may be made to include a conductor material. Therefore, when the strip 98 on each of the illumination pouches 90 are connected, they are electrically connected closing a circuit causing each to transfer power from the power source 94 to each of the illumination pouches 90 thereby illuminating all of the contents within each of the illumination pouches 90. Optionally, each illumination pouch 90 may include a separate power source 94.

Alternatively, an electrical connection may be made from a first connector (not shown) in the illumination pouch 90 including the power source 94 to a second receiving connector (not shown) in a second illumination pouch 90.

The power source 94 may be activated by a switching element such that illumination of the fiber optic fiber optic element 92 within the illuminating removable organizer system 100 is activated when the user opens their carrying bag carrying bag 11, or performs some other desired action, such as by depressing a button on the removable organizer system 10. In the alternative, a flashlight may be integrated as part of the removable organizer system 10 to provide the illumination.

The removable organizer system 10 is convenient for a variety of persons including, for example, mothers, fathers, professionals, students, shoppers, sport enthusiast, travelers and men and women alike.

It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed is:

1. A modular organizer system, comprising:

a first pouch having an opening for securely receiving and positioning an item in a preferred position, the first pouch having a first fastening mechanism disposed outside of, and along both sides of the first pouch; and a second pouch having an opening for securely receiving and positioning an item in a preferred position, the second pouch having a second fastening mechanism disposed outside of, and along both sides of the second pouch, wherein either side of the first fastening mechanism is adapted to be modularly fastened to, and outside of, either side of the second fastening mechanism of the second pouch in any preferred adjustable side-by-side orientation.

2. The modular organizer system recited in claim 1, wherein the modular organizer system is arranged within an open compartment of a carrying bag.

3. The modular organizer system recited in claim 1, wherein the modular organizer system includes a plurality of pouches interconnected with each other at various respective fastening mechanisms and arranged within an open compartment of a carrying bag so that an unfastened outer periphery of the pouches is molded to fit within an open compartment of a carrying bag.

4. The modular organizer system recited in claim 1, wherein the preferred orientation is at least one of a staggered and a side-by-side arrangement.

5. The modular organizer system recited in claim 1, wherein the fastening mechanism is at least one of a hook and eye mechanism and a magnetic mechanism.

6. The modular organizer system recited in claim 1, wherein the pouch is composed of a semi-rigid material capable of securing the various items in the preferred position within the pouch.

7. The modular organizer system recited in claim 1, further including a loop that secures at least one of a remote control and a key.

8. The modular organizer system recited in claim 1, wherein the pouch includes a closure mechanism chosen from at least one of a zipper, a snap and Velcro.

9. The modular organizer system recited in claim 1, wherein the pouch further includes an elastic band for attaching an item external to the pouch.

10. The modular organizer system recited in claim 1, further including a handle attached to the fastening mechanism of the pouch.

11. The modular organizer system recited in claim 1, wherein the pouch further comprises rigid dividers provided within the pouch to separate various items within the pouch.

12. The modular organizer system recited in claim 1, wherein the modular organizer system includes a billfold pouch capable of receiving flat elongated items.

13. The modular organizer system recited in claim 1, includes an adapter device capable of being used as an interconnecting cross-member between the first pouch and the second pouch.

14. The modular organizer system recited in claim 1, wherein the pouch further includes an illumination source.

15. The modular organizer system recited in claim 14 wherein the illumination source is at least one of a fiber optic and a flashlight.

16. The modular organizer system recited in claim 14 wherein the fiber optic is embedded in the pouch and operated by a power source.

17. The modular organizer system recited in claim 14, wherein the illumination source is a cooperative arrangement of fiber optics within various pouches electrically connected together and powered by the power source.

18. A modular organizer system, comprising:

a first pouch having an opening for receiving an item to be securely positioned within an open compartment of a carrying bag, the first pouch having a first fastening mechanism disposed outside of, and along both sides of the first pouch; and a second pouch having an opening for receiving an item to be securely positioned within the open compartment of the carrying bag, the second pouch having a second fastening mechanism disposed outside of, and along both sides of the second pouch, wherein either side of the first fastening mechanism is adapted to be modularly fastening to, and outside of, either side the second fastening mechanism of the second pouch in any preferred adjustable side-by-side orientation surrounding the first pouch.

19. A method for modularly organizing the contents of a carrying bag, comprising:

providing a first pouch for receiving an item to be securely positioned within an open compartment of a carrying bag, the first pouch having a first fastening mechanism disposed outside of, and along both sides of the first pouch;

providing a second pouch for receiving an item to be securely positioned within the open compartment of the carrying bag, the second pouch having a second fastening mechanism disposed outside of, and along both sides of the second pouch; and modularly fastening either side of the first fastening mechanism to, and outside of, either side of the second fastening mechanism disposed on the outside of the second pouch in any preferred adjustable side-by-side orientation for receiving additional items.

20. The method recited in claim 19, further comprising:

securely positioning the items in a preferred position that can be easily accessed from the opening of the carrying bag.

21. The method recited in claim 19, further comprising:

interconnecting a plurality of pouches to each other at various respective fastening mechanisms; and arranging the plurality of pouches within an open compartment of a carrying bag so that the unfastened outer periphery of the pouches is molded to fit within an open compartment of a carrying bag.

22. The method recited in claim 19, further including:

interconnecting the first pouch with at least one of the second pouch with an adapter device.

23. The method recited in claim 19, further including:

illuminating the pouches with an illumination source.

24. The method recited in claim 21, further comprising:

transferring the plurality of pouches together as a single modular interconnected unit from one carrying bag to another carrying bag.

* * * * *